United States Patent [19]

Buchanan

[11] Patent Number: 4,759,408

[45] Date of Patent: Jul. 26, 1988

[54] METHOD OF SHUTTING OFF A PORTION OF A PRODUCING ZONE IN A HYDROCARBON PRODUCING WELL

[75] Inventor: Steven M. Buchanan, Diamond Bar, Calif.

[73] Assignee: Texaco Inc., White Plains, N.Y.

[21] Appl. No.: 59,096

[22] Filed: Jun. 8, 1987

[51] Int. Cl.[4] ..... E21B 33/14; E21B 33/138; E21B 43/04

[52] U.S. Cl. ..... 166/278; 166/285; 166/287

[58] Field of Search ..... 166/276, 278, 241, 242, 166/281, 272, 285, 287; 175/406

[56] References Cited

U.S. PATENT DOCUMENTS

| | | | |
|---|---|---|---|
| 3,277,962 | 10/1966 | Flickinger et al. | 166/385 X |
| 3,368,623 | 2/1968 | Carter et al. | 166/276 |
| 3,682,244 | 8/1972 | Bowman et al. | 166/272 X |
| 3,709,298 | 1/1973 | Pramann | 166/276 |
| 4,034,811 | 7/1977 | Sparlin et al. | 166/295 |
| 4,157,116 | 6/1979 | Coulter | 166/281 X |
| 4,274,487 | 6/1981 | Hollingsworth et al. | 166/272 X |
| 4,378,843 | 4/1983 | Suman, Jr. | 166/278 |
| 4,589,490 | 5/1986 | Darr et al. | 166/276 |

*Primary Examiner*—George A. Suchfield
*Attorney, Agent, or Firm*—Jack H. Park; Kenneth R. Priem; Harold J. Delhommer

[57] ABSTRACT

Disclosed is an invention for shutting off a portion of a producing zone such as a steam override zone in a hydrocarbon producing wellbore. The bottom of the wellbore is filled with a material such as sand up to the bottom of the steam override zone. A pipe is placed and centralized in the middle of the wellbore so that the pipe extends throughout the steam override zone. A cement plug is placed around the centralized pipe while keeping the interior of the pipe free of cement. A larger cylindrical hole is then drilled through the cement plug by using the centralized pipe to center and guide a drill through the middle of the cement plug.

13 Claims, 1 Drawing Sheet

METHOD OF SHUTTING OFF A PORTION OF A PRODUCING ZONE IN A HYDROCARBON PRODUCING WELL

BACKGROUND OF THE INVENTION

This invention relates to a method of shutting off a portion of a producing zone in a producing wellbore through the use of a concrete plug.

The methods of plugging wellbores are numerous. Many procedures have been around for decades. Some involve nothing more than filling a hole with concrete, or as in the case of U.S. Pat. No. 3,831,383, using a prefabricated plug upon which a plastic or cement is poured.

A more difficult task than merely plugging a wellbore is trying to close off a portion of a producing zone while still leaving part of the producing interval open for production. In a steamflood for instance, a steam override zone may develop in the top portion of a producing interval, substantially inhibiting recovery of hydrocarbons from a producing well. One solution to the steam override problem is to drill a new well if the producing zone is within a couple of hundred feet of the surface.

A second solution that is employed commercially is to run a scab liner. This procedure involves hanging several hundred to several thousand feet of pipe inside the existing wellbore to cover the steam override zone, cementing around the steam override zone, and perforating at the bottom of the producing interval. But this solution suffers from the problem of high cost for many feet of extra steel and has the additional complexity of hanging the liner in the hole. A scab liner job also decreases the inside diameter of the wellbore. A smaller wellbore decreases the efficiency of workovers that can be performed upon that well.

For example, production wells used in steamfloods are subject to frequent workovers. The old liner has to be pulled and the damaged hole must be scraped away to get to the fresh native reservoir rock. This is done with the use of an underreamer which spreads out arms an effective working diameter larger than the casing to scrape the damaged hole clean in the production interval. The smaller the hole, the smaller sized underreamer that can be used. With a smaller underreamer, the chances of torquing off an arm of the underreamer or getting the tool stuck in the hole are substantially increased. Thus, running a smaller diameter liner in the hole to shut off a steam override zone reduces the number of future workovers that can be performed and increases the problems associated with such workovers.

Isolating the undesired portion of the producing zone with packers is generally unsatisfactory. Steam from an override zone will flow through the gravel pack or adjacent formation behind the liner and bypass the packers.

Another procedure that has been explored for shutting off a portion of a producing zone has been aptly named a cement donut. In this method, a cement plug is formed in the wellbore in the portion of the producing interval that is desired to be shut off. The operator drills through the cement plug in an attempt to make a new wellbore through the cement plug, while leaving the resulting cement donut to shut off the relevant portion of the producing interval. The cement donut technique, however, has not been successful due to the tendency of the drill bit to drift through the side of the cement sheath, exposing the portion of the producing interval to the wellbore.

SUMMARY OF THE INVENTION

The invention is a multi-stepped process of shutting off a portion of a producing zone in a hydrocarbon producing wellbore. The existing production liner is pulled. The bottom of the producing wellbore is filled with a non-formation-damaging material up to the bottom of the producing zone which is desired to be shut off. The non-formation-damaging material is used to isolate the portion of the producing zone from which production is still desired in the future. The non-formation-damaging material must also be a material such as sand or gravel which can be removed from the wellbore after the invention method is finished.

A liner or pipe is then placed and centralized in the middle of the wellbore so that the pipe extends through the portion of the producing zone desired to be shut off. A cement plug is formed throughout the portion of the producing zone desired to be shut off by cementing the centralized pipe to the wellbore while keeping the interior of the pipe free of cement. This creates a cement plug with a longitudinal cylindrical hole. A larger cylindrical hole is then drilled through the cement plug and the pipe therein by using the centralized pipe to center and guide a drill through the middle of the cement plug. Finally, the non-formation-damaging material is removed from the bottom of the wellbore. The wellbore can then be made ready for future production by the setting of a liner and gravel packing, or a similar production completion.

DETAILED DESCRIPTION

Figure 1:
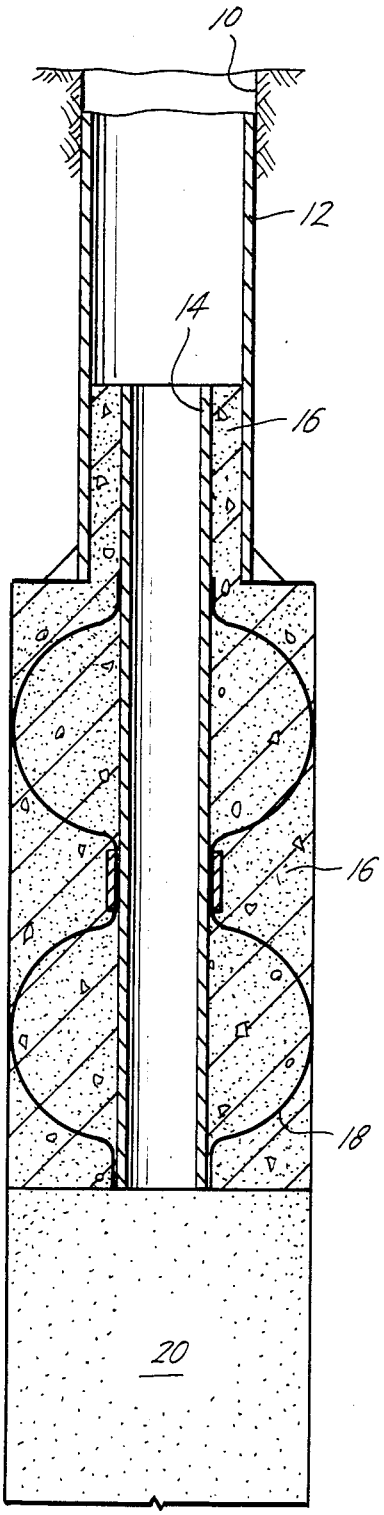
FIG. 1 is a vertical sectional view showing a wellbore wherein a cement plug has been formed in the wellbore containing a centralized pipe running longitudinally through the portion of the producing zone desired to be shut off.

The present invention provides a relatively low cost method of shutting off a portion of the producing interval in a production well with a concrete plug, while still permitting production from the producing interval below the shut off portion. Also, the same larger diameter wellbore can be maintained throughout the life of the well, increasing workover efficiency.

Although the invention method can be employed in injection wells and during drilling operations, it is believed that other methods offer better alternatives. For instance, a thief sand around an injection well may be closed by the injection of various materials. An operator does not usually worry about permanently damaging a thief sand with an injected material.

A hole washout during drilling operations is cheaper to cure by dumping lost circulation material in the hole. Because the hole wash-out is most likely to be in a non-productive area, an operator is usually not concerned about damaging the formation.

But in the case of a production well, an operator is unlikely to inject anything into the formation which cannot be easily removed from the formation or neutralized so as to avoid a permanent damaging effect on the producing interval. The present invention offers such a procedure to shut off a portion of a producing interval, such as a steam override zone without damaging the producing formation.

The multistep method of the present invention is begun by pulling the production liner. The bottom of the producing wellbore is filled up with a non-formation-damaging material which isolates the bottom portion of the producing zone from being shut off. The non-formation-damaging material must be a material such as sand or gravel which can be easily removed from the wellbore after the completion of the process. Sand is preferred since it is the cheapest material and is also the easiest non-formation-damaging material to wash out from the wellbore at the end of the process. A sand column of several hundred feet could be deposited to protect a very long producing zone from being shut off.

It is preferred to enlarge the wellbore passing through the producing zone desired to be shut off. This must be done prior to forming the cement plug to increase the wall thickness of the cement plug and allow the cement to extend farther into the formation, more effectively shutting off the producing zone. It may also be desirable to open up the wellbore in the producing area to be retained. The procedure of enlarging the wellbore in the portion of the formation desired to be shut off may be done before or after the bottom of the wellbore is filled with a non-formation-damaging material such as sand.

A pipe is placed and centralized in the middle of the wellbore so that the pipe extends longitudinally throughout the portion of the producing zone desired to be shut off. The pipe serves as a center guide for drilling through the cement plug. The pipe may be constructed of any material, but is preferably plastic, fiberglass, aluminum, or thin wall steel. It should be kept in mind that a harder construction material for the pipe makes drilling through the cement plug and pipe more difficult. A harder pipe material requires more weight on the drill bit and more pressure on the cement plug to drill a cylindrical hole through the cement plug. The increased pressure could fracture the cement.

The centralized pipe can theoretically be of any diameter smaller than the diameter of the wellbore. However, the invention procedure works best when the interior pipe diameter is of a slightly larger diameter than the drill guide, such as the pilot nose on a pilot nosed underreamer. Such a pipe for the selected inside diameter provides a guiding path through the cement plug for the drill bit.

The pipe must be centralized in the middle of the wellbore to provide for the ideal cylindrical hole drilled through the cement plug. This may be done with the use of centralizers placed around the pipe or liner. Since a portion of the centralizers will be drilled away, the same composition considerations apply to the centralizers as to the centralized pipe. Thus, it is preferred that the centralizers be composed of fiberglass, plastic, aluminum, or thin wall steel.

A cement plug is formed in the portion of the producing interval desired to be shut off by cementing the centralized pipe to the wellbore while keeping the interior of the pipe free of cement. A completion fluid should be used inside the centralized pipe to balance cementing and formation pressures and prevent the collapse of the pipe.

It should be recognized that the cement plug may be formed with most any material that would create a hydraulic barrier to the production of fluids from the portion of the producing interval desired to be shut off. In some circumstances, this may require material able to withstand temperature extremes. Various plastics, epoxies, hard setting gels and numerous types of cement may also be used to form the cement plug. Thus, it should be understood that the use of the word "cement" in the description and claims is not to be limited to a traditional form of cement, but should be interpreted to include any material which could be used to form a tough, impermeable barrier to produced fluids. In most cases, the cost of the material used to form the cement plug will be the deciding factor.

After the cement plug has set up, a cylindrical hole is drilled through the plug, drilling out the pipe therein by using the centralized pipe to center and guide the drill through the middle of the cement plug. Preferably, a drill such as a pilot nosed underreamer will be used to drill the cylindrical hole, wherein the pilot nosed underreamer has a pilot nose with an exterior diameter similar to and smaller than the interior diameter of the centralized pipe. The centralized, guiding pipe will allow drilling through the cement plug without drilling out through the side of the column or the fracturing of the cement plug by the drill bit bouncing on the top of the plug. Preferably, the cylindrical hole drilled through the cement plug will have a diameter equal to the diameter of the production casing. Thus, the drill will remove the centralized pipe as well as a portion of the cement plug surrounding the centralized pipe.

After the cylindrical hole is drilled through the cement plug, the non-formation-damaging material is then removed from the bottom of the wellbore. The wellbore can then be finished as desired in order to place the well back on production. For a steamflood project, this may involve placing a gravel pack and production liner below the shut off steam override zone after the sand is removed from the wellbore.

Figure 2:
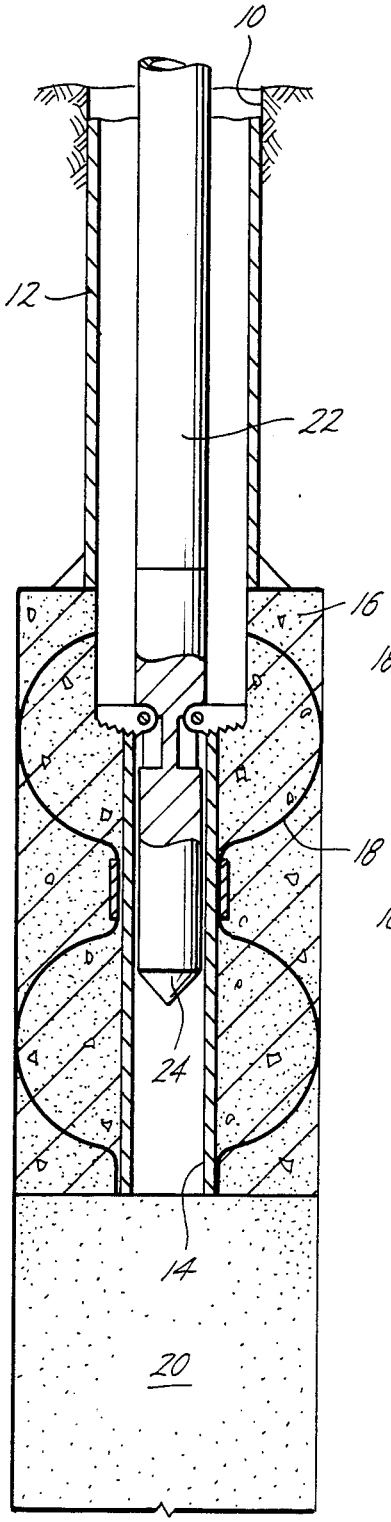
FIG. 2 is a vertical sectional view of the FIG. 1 wellbore wherein the center of the concrete plug is being drilled out.
Figure 3:
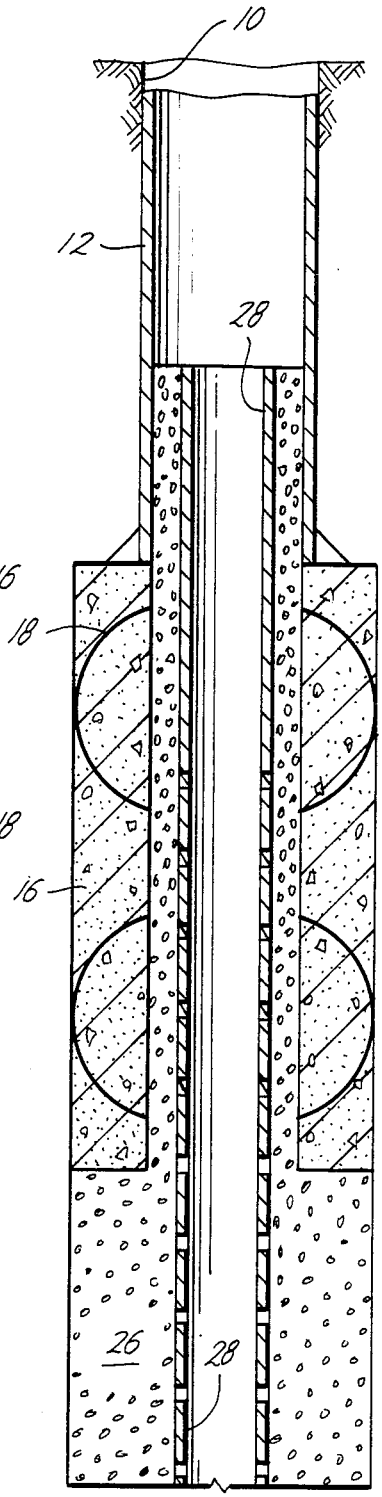
FIG. 3 is a vertical sectional view of the FIG. 1 wellbore wherein the invention method steps have been finished by placing a gravel pack and production liner in the wellbore.

FIGS. 1–3 illustrate the stepwise process of the invention. In these drawings, wellbore 10 is illustrated with casing 12. FIG. 1 shows sand as the non-formation-damaging material 20 which has been placed at the bottom of the wellbore to protect the portion of the producing interval desired to be retained. Cement plug 16 has been formed within the borehole at a steam override zone. Pipe 14 has been centralized in the cement plug 16 by centralizers 18.

In FIG. 2, drill 22 with pilot nose 24 is drilling a cylindrical hole through the cement plug, removing pipe 14 and a portion of the cement plug 16 and centralizers 18 surrounding the pipe 14. In FIG. 3, the process has been finished by the removal of the sand 20. Gravel pack 26 and production liner 28 have been inserted throughout the producing zone.

This invention procedure employing the centralized pipe running longitudinally through the cement plug provides a guide to drill a cylindrical hole through the cement plug. The resulting cement sheath will prevent producing fluids such as steam at the top of the producing zone from entering the wellbore and allow the oil below the shut off zone to be produced up through the hole in the cement plug.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. A method of shutting off a portion of a producing zone in a hydrocarbon producing wellbore which comprises:

pulling the existing production liner;

filling up the bottom of the producing wellbore to the level of the bottom of the producing zone desired to be shut off with a non-formation-damaging material which insulates a portion of the producing zone from being shut off and which can be removed from the wellbore;

placing and centralizing a pipe in the middle of the wellbore so that the pipe extends through the portion of the producing zone desired to be shut off;

forming a cement plug with a cylindrical hole throughout the portion of the producing zone desired to be shut off by cementing the centralized pipe to the wellbore while keeping the interior of the pipe free of cement;

drilling a cylindrical hole through the cement plug and drilling out the pipe therein by using the pipe therein to center and guide the drill through the middle of the cement plug; and removing the non-formation-damaging material from the bottom of the wellbore.

2. The method of claim 1, wherein a steam override zone is shut off.

3. The method of claim 1, wherein the non-formation-damaging material is sand, gravel or oyster shells.

4. The method of claim 1, further comprising enlarging the wellbore in the portion of the producing zone desired to be shut off prior to centralizing and cementing the pipe in place.

5. The method of claim 1, wherein the centralized pipe is composed of fiberglass, plastic, aluminum or thin wall steel.

6. The method of claim 1, further comprising using centralizers to centralize the pipe in the wellbore prior to forming the cement plug.

7. The method of claim 1, wherein the centralizers are composed of fiberglass, plastic, aluminum or thin wall steel.

8. The method of claim 1, further comprising the use of a pilot nosed underreamer to drill the cylindrical hole through the cement plug.

9. The method of claim 8, wherein the pilot nosed underreamer has a pilot nose with an exterior diameter similar to and smaller than the interior diameter of the centralized pipe.

10. The method of claim 1, further comprising using a completion fluid inside the centralized pipe to balance cementing and formation pressures on the pipe.

11. The method of claim 1, further comprising placing a gravel pack and production liner in the remaining portion of the producing zone of the wellbore after the non-formation-damaging material is removed from the wellbore.

12. A method of shutting off a steam override zone in a hydrocarbon producing wellbore, which comprises:

pulling the existing production liner;

enlarging the wellbore in the steam override zone;

filling up the bottom of the wellbore to the level of the bottom of the steam override zone with sand;

placing and centralizing a pipe having a selected inside diameter in the middle of the wellbore so that the pipe extends throughout the steam override zone;

using a completion fluid inside the centralized pipe to balance cementing and formation pressures;

forming a cement plug with a cylindrical hole throughout the steam override zone by cementing the centralized pipe to the enlarged wellbore in the steam override zone while keeping the interior of the pipe free of cement;

drilling a cylindrical hole through the plug and drilling out the pipe therein by using a pilot nosed underreamer which is guided and centered by the pipe within the cement plug, said pilot nosed underreamer having a pilot nose with an exterior diameter similar to and smaller than the selected inside diameter of the centralized pipe; and removing the sand from the bottom of the wellbore.

13. The method of claim 12, further comprising placing a gravel pack and production liner below the shut off steam override zone after the sand is removed from the wellbore.

* * * * *